US009340979B2

(12) United States Patent
Chabowski

(10) Patent No.: US 9,340,979 B2
(45) Date of Patent: May 17, 2016

(54) ROOF COVERING ELEMENT (TILE-LIKE SHEET) EQUIPPED WITH EMBOSSMENTS

(71) Applicant: Bogdan Wiecek BUDMAT, Plock (PL)

(72) Inventor: Andrzej Chabowski, Plock (PL)

(73) Assignee: BOGDAN WIECEK BUDMAT, Plock (PL)

( * ) Notice: Subject to any disclaimer, the term of this patent is extended or adjusted under 35 U.S.C. 154(b) by 0 days.

(21) Appl. No.: 14/394,612

(22) PCT Filed: Apr. 30, 2013

(86) PCT No.: PCT/PL2013/000050
§ 371 (c)(1),
(2) Date: Oct. 15, 2014

(87) PCT Pub. No.: WO2013/157968
PCT Pub. Date: Oct. 24, 2013

(65) Prior Publication Data

US 2015/0113902 A1 Apr. 30, 2015

(30) Foreign Application Priority Data

Apr. 17, 2012 (PL) ..... P.398857

(51) Int. Cl.
*E04D 1/00* (2006.01)
*E04D 1/36* (2006.01)
(Continued)

(52) U.S. Cl.
CPC *E04D 1/36* (2013.01); *E04D 1/265* (2013.01); *E04D 3/24* (2013.01); *E04D 3/30* (2013.01)

(58) Field of Classification Search
CPC ..... E04D 1/36; E04D 1/365; E04D 3/16; E04D 3/30; E04D 3/32; E04D 1/18; E04D 1/24; E04D 1/06; E04D 1/265; E04D 3/24; E04D 1/12
See application file for complete search history.

(56) References Cited

U.S. PATENT DOCUMENTS 37,450 A 1/1863 Lasserre
121,438 A 11/1871 Wands
(Continued)

FOREIGN PATENT DOCUMENTS

CA 2868563 A1 10/2013
CA 2868566 A1 9/2014
(Continued)

OTHER PUBLICATIONS

International Search Report of PCT/PL2013/000050 mailed Jul. 15, 2013.
(Continued)

*Primary Examiner* — Brian Mattei
(74) *Attorney, Agent, or Firm* — Roberts Mlotkowski Safran & Cole, P.C.

(57) ABSTRACT

A roof covering element (a tile-like sheet) equipped with embossments according to the present invention characterizes in that the surface of the lower edge (2) of the roof covering element (1) has at least one embossment (3) done downwards and inwards in relation to the roof covering element (1) with an assembling hole (4) prepared centrally. A bottom of that embossment (3) is at zero or acute angle with the surface of the lower edge (2). The surface of the upper edge (5) of the roof covering element (1) has at least one embossment (6) done downwards and inwards in relation to the covering element (1) with an assembling hole (7) prepared centrally. A bottom of that embossment (6), preferably of circular shape, is at zero or acute angle with the surface of the upper edge (5).

8 Claims, 7 Drawing Sheets

(51) Int. Cl.

| | |
|---|---|
| ***E04D 3/24*** | (2006.01) |
| ***E04D 3/30*** | (2006.01) |
| ***E04D 1/26*** | (2006.01) |

(56) References Cited

U.S. PATENT DOCUMENTS

| | | | | |
|---|---|---|---|---|
| 737,078 | A | 8/1903 | Chapman | |
| 805,884 | A | 11/1905 | Satterlee | |
| 1,386,130 | A | 8/1921 | Marks et al. | |
| 1,491,015 | A | 4/1924 | Mc Farland | |
| 1,729,946 | A | 3/1926 | Kuehn | |
| 1,658,591 | A | 2/1928 | Dorn | |
| 1,816,439 | A | 8/1930 | Masters | |
| 1,914,876 | A | 6/1933 | Workman | |
| 1,955,699 | A | 4/1934 | Moffit | |
| 2,076,989 | A | 4/1937 | Harpham | |
| 2,424,410 | A | 7/1947 | Miles | |
| 2,486,168 | A | 10/1949 | Jurasevich | |
| 2,685,852 | A | 8/1954 | Godel | |
| 2,737,267 | A | 3/1956 | Koch | |
| 1,913,342 | A | 6/1966 | Schaffert | |
| 3,269,075 | A | 8/1966 | Cosden et al. | |
| 3,754,366 | A * | 8/1973 | Jansson et al. | 52/535 |
| 3,760,545 | A | 9/1973 | Pearse et al. | |
| 3,897,667 | A | 8/1975 | Turek | |
| 4,001,997 | A * | 1/1977 | Saltzman | 52/521 |
| 4,102,106 | A * | 7/1978 | Golder et al. | 52/533 |
| 4,133,161 | A | 1/1979 | Lester | |
| 4,178,731 | A | 12/1979 | Petersson | |
| 4,262,462 | A | 4/1981 | Melbye | |
| 4,554,773 | A | 11/1985 | Conley | |
| 4,592,185 | A * | 6/1986 | Lynch et al. | 52/543 |
| 4,598,522 | A * | 7/1986 | Hoofe, III | 52/555 |
| 4,616,465 | A | 10/1986 | Byers et al. | |
| 4,617,773 | A | 10/1986 | Studwell | |
| 5,752,355 | A | 5/1998 | Sahramaa | |
| 5,878,543 | A * | 3/1999 | Mowery | 52/519 |
| 6,269,604 | B1 * | 8/2001 | Pedersen | 52/537 |
| RE38,210 | E | 8/2003 | Plath et al. | |
| 7,316,099 | B2 | 1/2008 | Faulkner et al. | |
| 7,690,169 | B2 | 4/2010 | Saarenko et al. | |
| 7,980,036 | B2 | 7/2011 | Takayasu et al. | |
| 8,291,664 | B2 | 10/2012 | Hanig | |
| 2005/0102930 | A1 * | 5/2005 | Saarenko et al. | 52/198 |
| 2007/0144097 | A1 * | 6/2007 | Saarenko et al. | 52/539 |
| 2010/0132275 | A1 | 6/2010 | Stranger | |
| 2011/0146199 | A1 | 6/2011 | Ferrante et al. | |
| 2011/0154767 | A1 * | 6/2011 | Perttula et al. | 52/518 |
| 2015/0113902 | A1 | 4/2015 | Chabowski | |
| 2015/0275519 | A1 | 10/2015 | Chabowski | |
| 2015/0361667 | A1 | 12/2015 | Chabowski | |

FOREIGN PATENT DOCUMENTS

| | | | |
|---|---|---|---|
| CA | 2870817 | A1 | 10/2014 |
| DE | 2157284 | | 5/1972 |
| EA | 201401301 | A1 | 3/2015 |
| EA | 201401131 | A1 | 6/2015 |
| EA | 201401302 | A1 | 6/2015 |
| EP | 2839090 | A1 | 2/2015 |
| FR | 2824856 | A1 | 11/2002 |
| GB | 203132 | | 9/1923 |
| JP | 11124964 | | 5/1999 |
| NL | 7712976 | | 9/1978 |
| PL | 339424 | A1 | 12/2000 |
| PL | 206210 | | 12/2004 |
| PL | 379919 | | 12/2007 |
| PL | 396691 | A1 | 4/2013 |
| PL | 398857 | A1 | 10/2013 |
| PL | 403087 | | 9/2014 |
| PL | 403552 | A1 | 10/2014 |
| WO | 99/16985 | A1 | 4/1999 |
| WO | 0111160 | | 2/2001 |
| WO | 2006018472 | | 2/2006 |
| WO | 2009/056683 | A1 | 5/2009 |
| WO | 2013157968 | A1 | 10/2013 |
| WO | 2014142690 | | 9/2014 |
| WO | 2014171845 | A1 | 10/2014 |

OTHER PUBLICATIONS

Office Action for U.S. Appl. No. 14/432,746 dated Aug. 3, 2015; 11 Pages.

International Search Report of International Application No. PCT/PL2013/000099 mailed Dec. 18, 2013.

International Search Report of International Application No. PCT/PL2014/000021 mailed Jun. 30, 2014.

International Preliminary Report on Patentability of PCT/PL2013/000050 dated Oct. 21, 2014.

International Preliminary Report on Patentability of PCT/PL2013/000099 dated Oct. 20, 2015.

International Preliminary Report on Patentability of PCT/PL2014/000021 dated Sep. 15, 2015.

* cited by examiner

ROOF COVERING ELEMENT (TILE-LIKE SHEET) EQUIPPED WITH EMBOSSMENTS

The present invention relates to a roof covering element (tile-like sweet) equipped with embossments.

The roof covering element made of a board material, comprising the first and second side edges, upper and lower edges, is known from the patent application description no. P396691. The element has series of modules substantially done parallel to the side edges, creating upper and lower plane. The modules have two or more wave-shaped ribs stretched parallel to the upper and lower edges. One of the ribs is done in the lower edge in form of profiled bends folded beneath the roof covering element. The lower bend is at the right angle to the lower plane. Upper part of the lower bend links with the lower plane by an arch. Lower part of the lower bend ends as an arched slant directed beneath the roof covering element. The roof covering element has the upper rib, which cross-section is in form of the upper bend at the right angle to the upper plane and to the ending plane of the roof covering element. Lower part of the upper bend forms a semicircular deflection folded outwards the roof covering element and which links with the upper plane. Upper part of the upper bend links with the ending plane of the roof covering plane by an arch.

The roof cladding in form of a panel is also known from the international patent application no. WO9916985A1. The panel is profiled in its longitudinal direction and stepped in its transverse direction. It comprises two straight side edges, which are connected to adjacent panels. A lower edge, which is wave-shaped, is connectable to an adjacent panel. An upper edge is straight and connectable to an adjacent panel. Two diagonally opposite corners of the panel are obliquely cut. An upper cut corner of one panel is adapted to be assembled with a lower cut corner of another panel. The panel has fixed marks or nests for fastening means, such as screws. These nests are formed as sunken embossing in the upper surface of the panel.

The roof covering element (tile-like sheet) equipped with embossments according to the invention characterises in that the surface of the lower edge of the roof covering element has at least one embossment done downwards and inwards in relation to the roof covering element with an assembling hole prepared centrally. A bottom of the embossment is at zero or acute angle with the surface of the lower edge. The surface of the upper edge of the roof covering element has at least one embossment done downwards and inwards in relation to the roof covering element with an assembling hole prepared centrally. A bottom of the embossment is at zero or acute angle with the surface of the upper edge.

The bottom of embossment done in the lower edge surface is preferably circle-shaped. The bottom of embossment done in the upper edge surface is preferably circle-shaped.

Edges of the assembling hole in the lower edge surface are bent downwards and inwards in relation to the roof covering element. Edges of the assembling hole in the upper edge surface are bent downwards and inwards in relation to the roof covering element.

The assembling hole in the lower edge surface is done in a sunken embossment with a flat bottom parallel to the lower edge surface. The assembling hole in the upper edge surface is done in a sunken embossment with a flat bottom parallel to the upper edge surface.

A distance from the centre of the assembling hole done in an embossment in the lower edge surface to a bottom plane of the lower wave-shaped plane is greater than a distance from a centre of, the corresponding to it, assembling hole done in the embossment done in the upper edge surface to a bottom plane of the ending surface of the roof covering element, by a value equal to the thickness of material of which the roof covering is made of.

The roof covering element (tile-like sheet) equipped with embossments according to the invention provides efficient assembling of adjacent panels. During mounting, a position of the holes for assembling screws in the embossments done at an acute angle to the lower edge and the upper edge surfaces of the panels clung together and to a rafter enables a driving of screws during screwing together which result in additional tightening of both surfaces of panels edges to the rafter surface. During mounting, a screw driving at a proper angle to a rafter surface is facilitated by deflection of edges of the holes for assembling screws. The assembling holes done in the lower and upper edge surfaces show the best site for screwing. The assembling holes are done in such way, that after placing of the lower edge of one panel onto the upper edge of an adjacent panel, a centre of the assembling hole in the lower edge surface is approximately in the same position as a centre of the corresponding assembling hole in the upper edge surface of the other panel. Preparation of the assembling holes results in no need for drilling with self-tapping screws through an intact panel material. Metal chips produced during such drilling are non-removable from under a mounted panel surface and they become a harmful corrosion centre. Preparation of the assembling holes avoids the chips formation. Additionally, preparation of the assembling holes in panel corners significantly facilitates mounting at the point of four adjacent panels placed one on another.

The subject of the invention is presented in exemplary embodiments in drawings on which FIG. 1 illustrates an axonometric view of a roof covering element (a tile-like sheet) equipped with embossments;

FIG. 2 shows a view and cross-section of an assembling hole in an embossment in a lower edge surface;

FIG. 3 demonstrates a view and cross-section of an assembling hole in an embossment in an upper edge surface;

Figure 1:
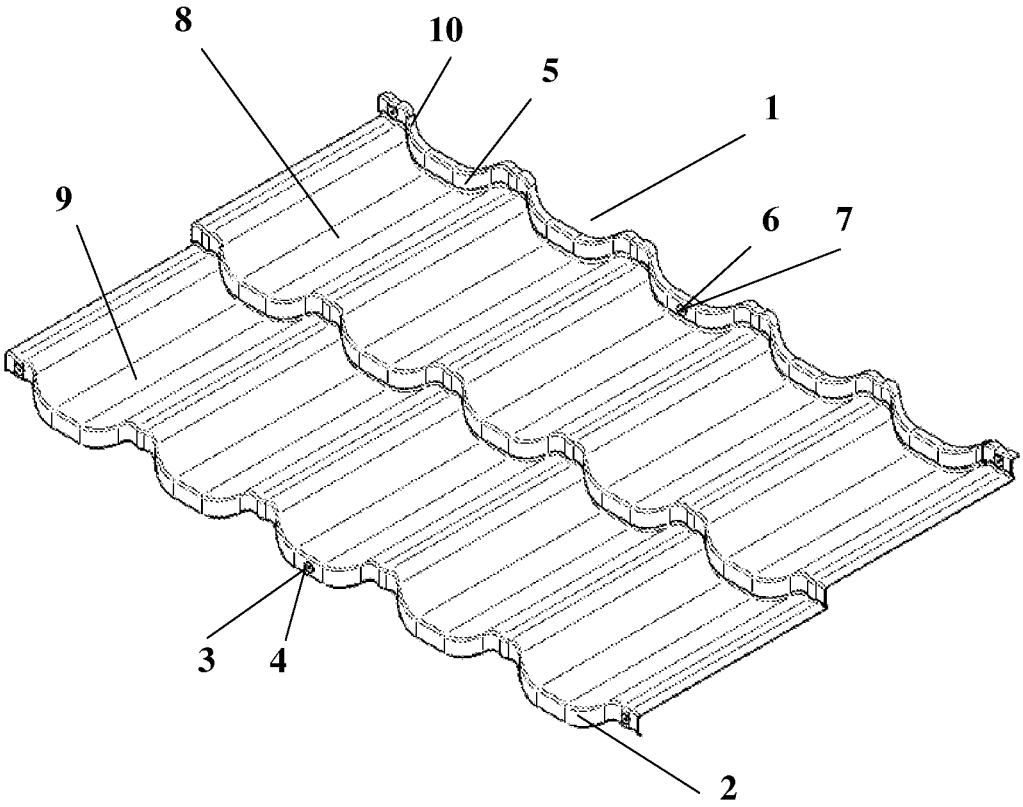
Figure 2:
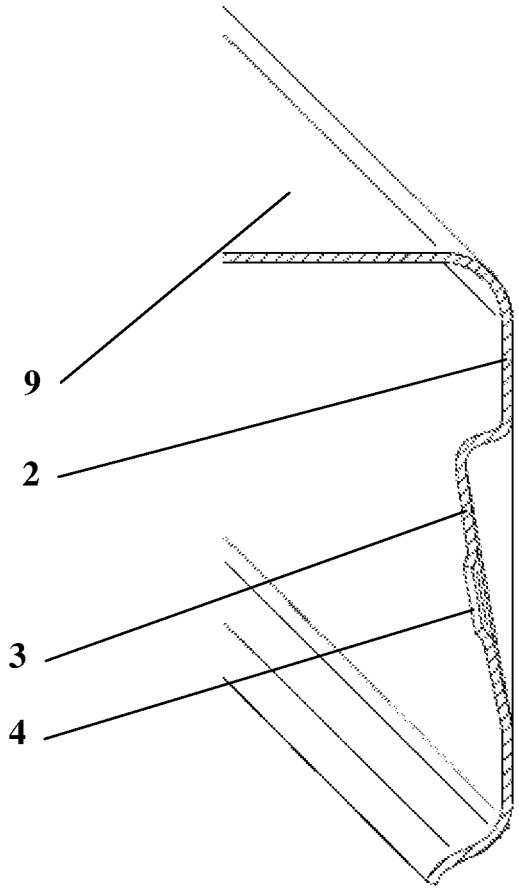
Figure 3:
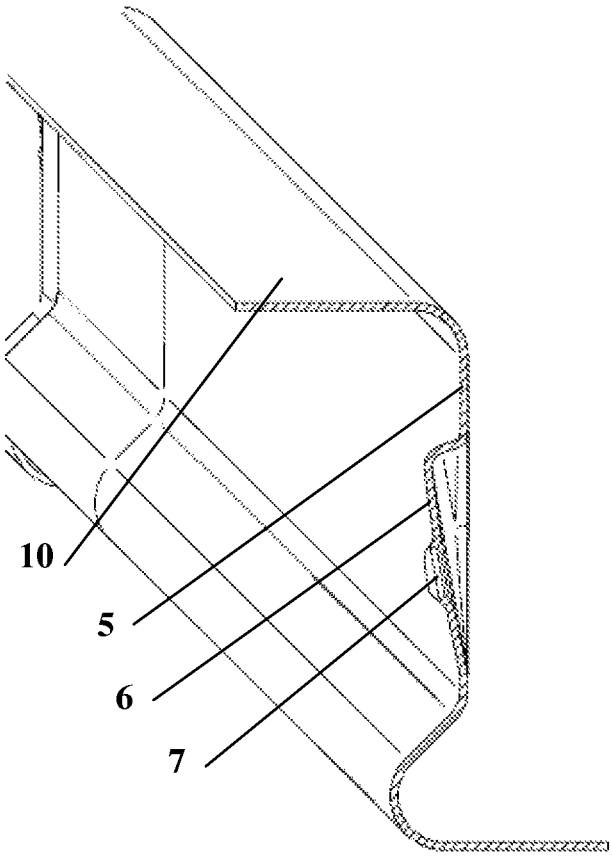
Figure 4:
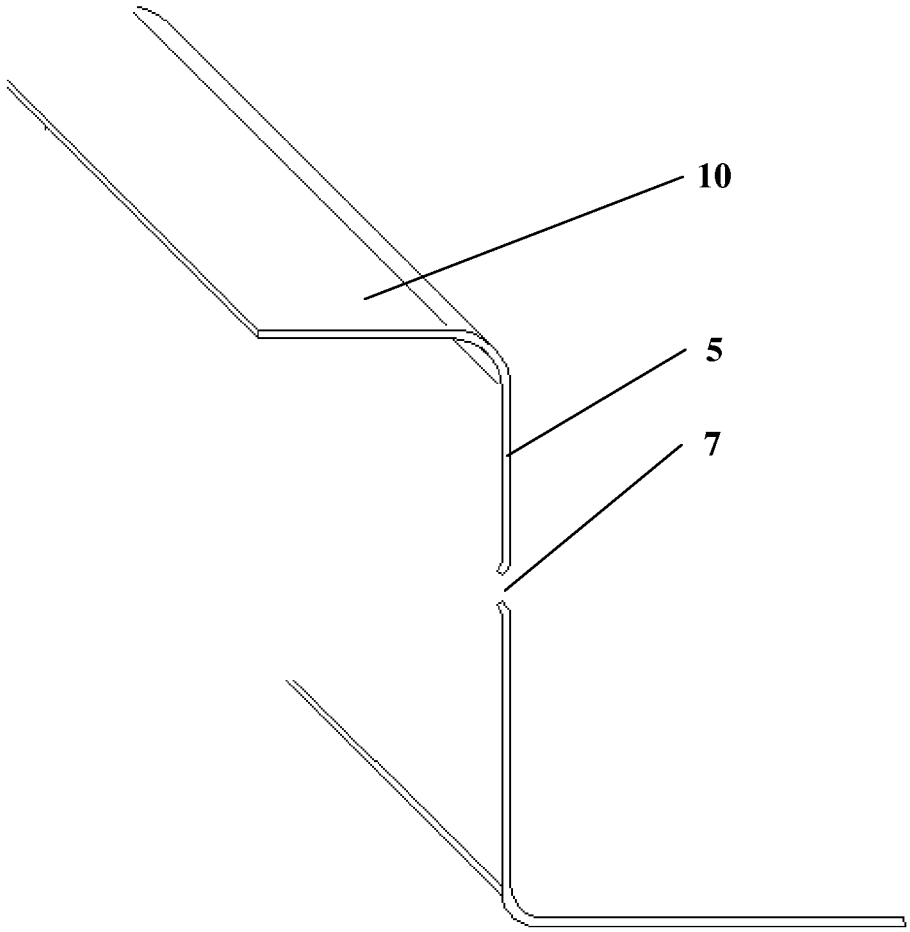
FIG. 4 shows a view and cross-section of an assembling hole in an upper edge surface.
Figure 5:
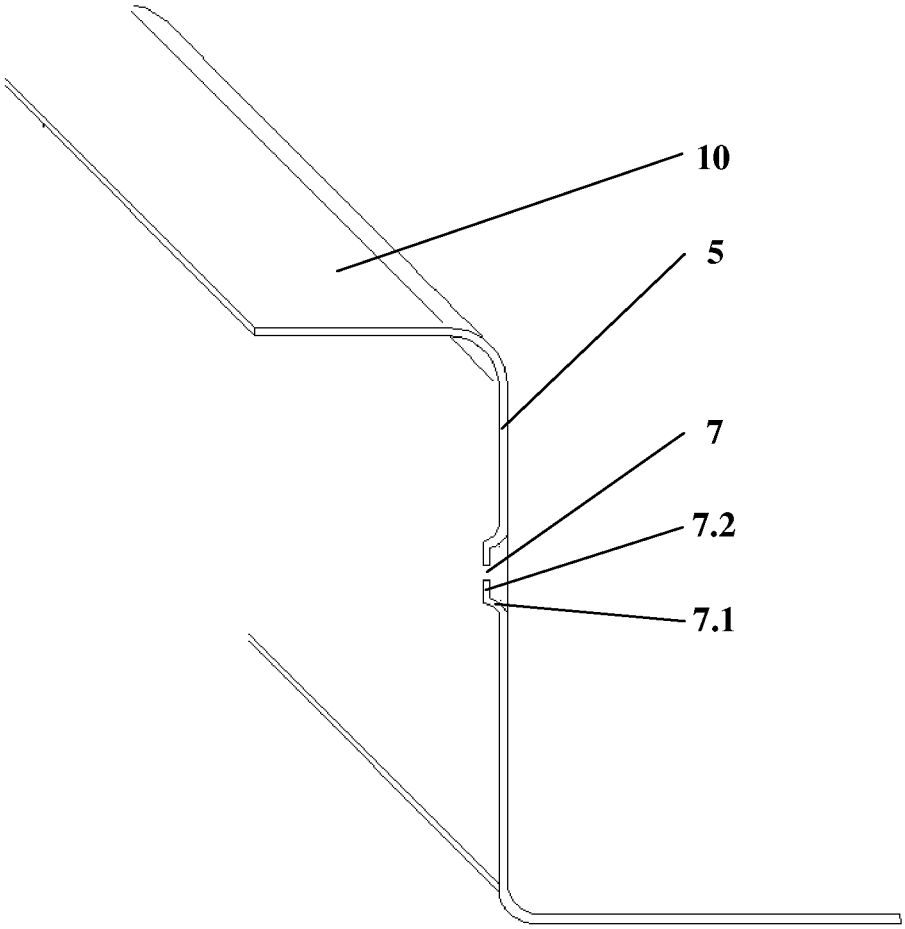
FIG. 5 illustrates a view and cross-section of an assembling hole in a sunken embossment in an upper edge surface.
Figure 6:
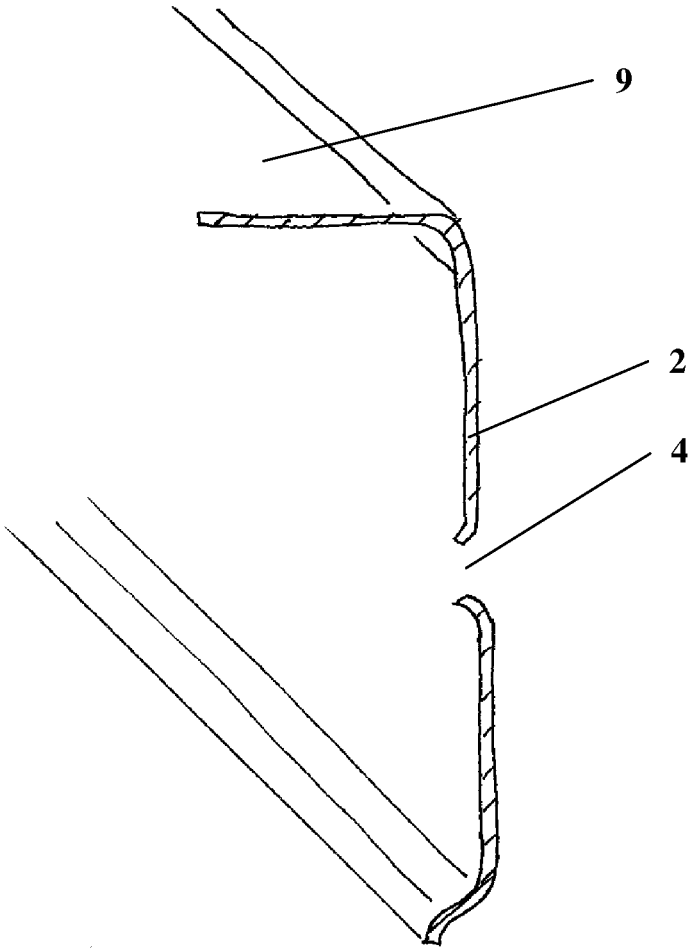
FIG. 6 shows a view and cross-section of an assembling hole in a lower edge surface.
Figure 7:
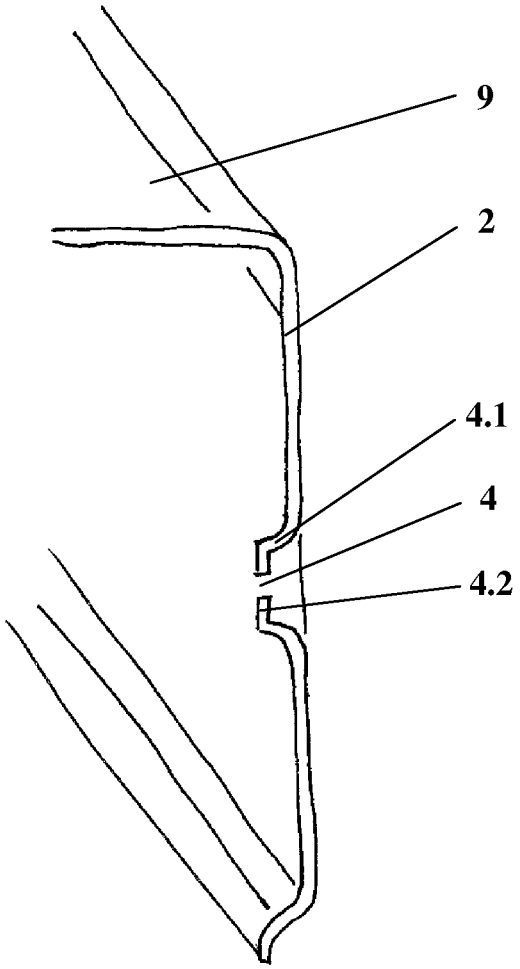

FIG. 7 demonstrates a view and cross-section of an assembling hole in a sunken embossment in a lower edge surface.

A roof covering element (tile-like sheet) equipped with embossments according to the invention characterises in that the surface of the lower edge 2 of the roof covering element 1 has at least one embossment 3 done downwards and inwards in relation to the roof covering element 1 with an assembling hole 4 prepared centrally, which edges are bent downwards and inwards in relation to the roof covering element 1. A bottom of that embossment 3, preferably of circular shape, is at zero or acute angle with the surface of the lower edge 2. The surface of the upper edge 5 of the roof covering element 1 has at least one embossment 6 done downwards and inwards in relation to the roof covering element 1 with an assembling hole 7 prepared centrally, which edges are bent downwards and inwards in relation to the roof covering element 1. A bottom of that embossment 6, preferably of circular shape, is at zero or acute angle with the surface of the upper edge 5.

In other embodiment, an assembling hole 4 in the lower edge 2 surface is done in a sunken embossment 4.1 with a flat bottom 4.2 parallel to the lower edge 2 surface, while an assembling hole 7 in the upper edge 5 surface is done in a sunken embossment 7.1 with a flat bottom 7.2 parallel to the upper edge 5 surface.

A distance from the centre of the assembling hole 4 done in an embossment 3 in the lower edge 2 surface to a bottom plane of the lower wave-shaped plane 9 is greater than a distance from a centre of, a corresponding to it, assembling hole 7 done in the embossment 6 done in the upper edge 5 surface to a bottom plane of the ending surface 10 of the roof covering element 1, by a value equal to the thickness of material of which the roof covering 1 is made of.

A LIST OF SYMBOLS ON DRAWINGS

1 roof covering element
2 lower edge surface
3 embossment
4 assembling hole
4.1 sunken embossment of assembling hole
4.2 flat bottom of sunken embossment of assembling hole
5 upper edge surface
6 embossment
7 assembling hole
7.1 sunken embossment of assembling hole
7.2 flat bottom of sunken embossment of assembling hole
8 upper wave-shaped plane
9 lower wave-shaped plane
10 ending surface

The invention claimed is:

1. A roof covering element in the form of a tile-like sheet, having side edges, upper and lower edges, the roof covering element comprising a series of modules including upper and lower planes, each of the series of modules including side edges and wave-shaped ribs stretched parallel to upper and lower edges, wherein the rib in the lower edge is in the form of a profiled bend having an upper part extending into the lower plane, and a lower part terminating with an arched slant directed beneath the roof covering element, and wherein the rib in the upper edge is in the form of a second profiled bend having an upper part extending into an ending surface and a lower part extending into the upper plane, characterized in that a surface of the lower edge (2) of the roof covering element (1) has at least one embossment (3) extending downwards and inwards in relation to the surface of the lower edge (2), with an assembling hole (4) formed centrally therein, and a bottom of the embossment (3) is at a zero or an acute angle with respect to the surface of the lower edge (2), and a surface of the upper edge (5) of the roof covering element (1) has at least one embossment (6) extending downwards and inwards in relation to the the surface of the upper edge (5) with an assembling hole (7) formed centrally therein, and a bottom of the embossment (6) is at a zero or an acute angle with respect to the surface of the upper edge (5), wherein the angle of the bottom of the embossment in the surface of the lower edge matches the angle of the bottom of the embossment in the surface of the upper edge.

2. A roof covering element (tile-like sheet) according to the claim 1 characterized in that the bottom of the embossment (3) of the lower edge (2) surface is circle-shaped.

3. A roof covering element (tile-like sheet) according to the claim 1 characterized in that the bottom of embossment (6) of the upper edge (5) surface is circle-shaped.

4. A roof covering element (tile-like sheet) according to the claim 1 characterized in that edges of the assembling hole (4) in the lower edge (2) surface are bent downwards and inwards in relation to the the surface of the lower edge (2).

5. A roof covering element (tile-like sheet) according to the claim 1 characterized in that edges of the assembling hole (7) in the upper edge (5) surface are bent downwards and inwards in relation to the the surface of the upper edge (5).

6. A roof covering element (tile-like sheet) according to the claim 1 characterized in that the assembling hole (4) in the lower edge (2) surface is formed as a sunken embossment (4.1) with a flat bottom (4.2) parallel to the lower edge (2) surface.

7. A roof covering element (tile-like sheet) according to the claim 1 characterized in that the assembling hole (7) in the upper edge (5) surface is formed as a sunken embossment (7.1) with a flat bottom (7.2) parallel to the upper edge (5) surface.

8. A roof covering element (tile-like sheet) according to the claim 1 characterized in that a distance from a center of the assembling hole (4) in the embossment (3) in the lower edge (2) surface to a bottom plane of the lower plane (9) is greater than a distance from a center of the assembling hole (7) in the embossment (6) in the upper edge (5) surface to a bottom plane of the ending surface (10) of the roof covering element (1), by a value equal to the thickness of material of which the roof covering (1) is made of.

* * * * *